US011198973B2

(12) United States Patent
Backfolk et al.

(10) Patent No.: US 11,198,973 B2
(45) Date of Patent: Dec. 14, 2021

(54) PRE-MIX USEFUL IN THE MANUFACTURE OF A FIBER BASED PRODUCT

(71) Applicant: Stora Enso OYJ, Helsinki (FI)

(72) Inventors: Kaj Backfolk, Villmanstrand (FI); Isto Heiskanen, Imatra (FI); Esa Saukkonen, Lappeenranta (FI)

(73) Assignee: Stora Enso OYJ, Helsinki (FI)

( * ) Notice: Subject to any disclaimer, the term of this patent is extended or adjusted under 35 U.S.C. 154(b) by 0 days.

(21) Appl. No.: 16/465,426

(22) PCT Filed: Nov. 30, 2017

(86) PCT No.: PCT/IB2017/057526
§ 371 (c)(1),
(2) Date: May 30, 2019

(87) PCT Pub. No.: WO2018/100524
PCT Pub. Date: Jun. 7, 2018

(65) Prior Publication Data

US 2020/0002893 A1 Jan. 2, 2020

(30) Foreign Application Priority Data

Dec. 1, 2016 (SE) ..... 1651582-7

(51) Int. Cl.

| | |
|---|---|
| ***D21H 11/18*** | (2006.01) |
| ***D21H 17/68*** | (2006.01) |
| ***D21H 17/29*** | (2006.01) |
| ***D21H 17/55*** | (2006.01) |
| ***D21H 17/45*** | (2006.01) |
| ***D21H 23/04*** | (2006.01) |

(52) U.S. Cl.
CPC ..... *D21H 11/18* (2013.01); *D21H 17/29* (2013.01); *D21H 17/45* (2013.01); *D21H 17/55* (2013.01); *D21H 17/68* (2013.01); *D21H 23/04* (2013.01)

(58) Field of Classification Search
None
See application file for complete search history.

(56) References Cited

U.S. PATENT DOCUMENTS

| | | | | |
|---|---|---|---|---|
| 4,495,245 | A * | 1/1985 | Zunker | B82Y 30/00 428/403 |
| 2012/0132383 | A1* | 5/2012 | Laine | D21H 17/69 162/175 |
| 2013/0280545 | A1 | 10/2013 | Husband et al. | |
| 2014/0302336 | A1 | 10/2014 | Heiskanen et al. | |
| 2016/0319487 | A1 | 11/2016 | Hietaniemi et al. | |

FOREIGN PATENT DOCUMENTS

| | | | |
|---|---|---|---|
| JP | S63203894 | A | 8/1988 |
| JP | H01246495 | A | 10/1989 |
| JP | 2014503696 | A | 2/2014 |
| JP | 2014530946 | A | 11/2014 |
| WO | 2010125247 | A2 | 11/2010 |
| WO | 2011055017 | A1 | 5/2011 |
| WO | 2012098296 | A2 | 7/2012 |
| WO | 2014154937 | A1 | 10/2014 |
| WO | 2015101498 | A1 | 7/2015 |
| WO | 2015101498 | A2 | 7/2015 |
| WO | 2015101499 | A1 | 7/2015 |

OTHER PUBLICATIONS

Smook, Gary A., Handbook for Pulp and Paper Technologists, 2nd ed, Angus Wilde Publications, 1992, p. 225. (Year: 1992).*

International Searching Authority, Written Opinion of the International Searching Authority, PCT/IB2017/057526, dated Jun. 7, 2018.

International Searching Authority, International Search Report, PCT/IB2017/057526, dated Jun. 7, 2018.

He, Ming et al., "Effect of precipitated calcium carbonate-Cellulose nanofibrils composite filler on paper properties," Carbohydrate Polymers 136 (2016), pp. 820-825.

Kretzschmar, J. et al., "Saving paper strength by using composites of filler and cellulosic fibrils," ipw Sep. 2013, www.ipwonline.de, pp. 30-32.

Chinga-Carrasco, G., "Cellulose fibres, nanofibrils and microfibrils: The morphological sequence of MFC components from a plant physiology and fibre technology point of view," Nanoscale Research Letters 2011, 6:417, pp. 1-7.

Fengel, D., "Ultrastructural behavior of cell wall polysaccharides," Tappi J., Mar. 1970, vol. 53, No. 3.

* cited by examiner

*Primary Examiner* — Dennis R Cordray

(74) *Attorney, Agent, or Firm* — Greer, Burns & Crain, Ltd.

(57) ABSTRACT

The present invention relates to a process wherein microfibrillated cellulose (MFC) is mixed with at least two retention aids, selected from a cationic or amphoteric polymer and a microparticle or nanoparticle as a pre-mix before dosing it to the stock in a process for manufacture of a fiber based product.

7 Claims, No Drawings

PRE-MIX USEFUL IN THE MANUFACTURE OF A FIBER BASED PRODUCT

This application is a U.S. National Phase under 35 U.S.C. § 371 of International Application No. PCT/IB2017/057526, filed Nov. 30, 2017, which claims priority under 35 U.S.C. §§ 119 and 365 to Swedish Application No. 1651582-7, filed Dec. 1, 2016.

TECHNICAL FIELD

The present invention relates to a process wherein microfibrillated cellulose (MFC) is mixed with at least two retention aids, selected from a cationic or amphoteric polymer and a microparticle or nanoparticle as a pre-mix useful in a process for manufacture fiber based products such as paper, board, tissues, nonwoven products or films.

BACKGROUND

In systems where a high amount of fine materials or water soluble additives are being dosed in a process for manufacture of fiber based products, it is very difficult to mix other functional chemicals, such as retention agents, into the system. Dosing retention system into a multicomponent furnish might, for example, lead to uneven charge neutralization of the system or fluctuations in the retention or uneven and/or irreversible flocculation.

The mixing efficiency of retention and dewatering chemicals may also be reduced if other chemicals are blocking the sites on microfibrillated cellulose (MFC) or fines or if other chemicals are consuming the retention chemicals.

WO2014154937 A1 relates to a method for production of paper or board comprising providing a stock comprising cellulose fibers, adding a mixture comprising microfibrillated cellulose and a strength additive to the stock, adding a microparticle to the stock after the addition of said mixture, dewatering the stock on a wire to form a web, and drying the web.

WO2011055017 A1 relates to a process for the preparation of paper or board comprising: adding a retention system to a stream of stock entering a paper machine head box, directing the stream of stock to a wire, dewatering the stream of stock on the wire to form a paper web, and drying the paper web, wherein the retention system comprises a water-soluble cationic polymer, and nanocellulose supposedly acting like a micro particle, wherein the nanocellulose is added in an amount of less than 1% as active substance based on dry solids weight of the stock. The intention is that the nanocellulose should act like a microparticle and that the use of inorganic microparticles can thereby be avoided. According to WO2011055017, the components are added sequentially.

There is thus a need for a method that facilitates the mixing of functional process chemicals such as retention aids into a system that contains a high amount of fine cellulose materials. Moreover, the prior art also emphasizes that adjustable control of reversible flocculation is required in order to increase retention and dewatering on a wire. There is also a need to enhance the physical—chemical interaction efficiency of the MFC with other chemicals, fibrils, fillers, and fibers in suspensions disclosed above.

SUMMARY

It is an object of the present disclosure to provide an improved way of dosing MFC and retention aids in a process for manufacturing fiber based products. In one embodiment, by preparing a pre-mix before dosing it to the stock in a process for manufacture of paper or board, re-flocculation of MFC and retention properties can be improved. The use of a pre-mix according to the present invention facilitates dewatering and enables higher speeds of the paper or board machine.

It has surprisingly been found that by making a pre-mix of retention chemicals and MFC, the retention of MFC is more efficient. In addition, the retention of both organic and inorganic components is improved. The improved retention typically leads to cleaner white water and thereby reduced total organic carbon (TOC), chemical oxygen demand (COD) and biological oxygen demand (BOD) of said white water.

The pre-mix according to the present invention is particularly useful in systems comprising high amounts of colloidal substances, nanofibers, nano- or microfillers, water soluble polymers or colloids such as starch, cellulose derivatives, latex etc. The pre-mix according to the present invention is also suitable for high speed dewatering and furnishes with slow dewatering behavior.

The present invention is thus directed to a process for the production of a fiber based product comprising the step of preparing a pre-mix comprising:

a) microfibrillated cellulose, wherein the amount of the microfibrillated cellulose is 0.1 kg to 50 kg per ton dry furnish;
b) cationic or amphoteric polymer, wherein the amount of the cationic or amphoteric polymer in the mixture is 0.01 kg to 10 kg per ton dry furnish; and
c) microparticles or nanoparticles, wherein the amount of microparticles or nanoparticles is 0.01 kg to 10 kg per ton dry furnish;

and dosing said pre-mix to the stock in a process for manufacture of a fiber based product.

The microparticles or nanoparticles used in accordance with the present invention are retention aids, i.e. influence the water retention properties in the process for preparing a fiber based product.

The microparticles used according to the present invention have an individual average diameter, in one dimension, of from 0.1 to 10 μm such as from 0.2 to 10 μm or from 0.2 to 5 μm, but can form clusters which are thus larger aggregates of microparticles. Preferably, at least 90% of the microparticles have a diameter in this range. In one embodiment, the microparticles are inorganic. The microparticles are essentially insoluble in water. The microparticles can be e.g. silica or modified silica or silicates, alumina, microclays such as montmorillonite or bentonite, microbentonite, latex, starch, etc. In one embodiment of the present invention, the microparticles are silica or microsilica. In one embodiment of the invention, the microparticles are anionic. In one embodiment of the invention, said silica or microsilica is anionic at neutral or alkaline pH. In one embodiment of the present invention, the microparticles are amphoteric at neutral or alkaline pH. In one embodiment of the present invention, the microparticles are non-ionic.

When nanoparticles are used, the nanoparticles can be e.g. silica or modified silica or silicates, alumina, nanoclays such as montmorillonite or bentonite, nanobentonite, latex, starch, etc. In one embodiment, the nanoparticles are inorganic. In one embodiment, the nanoparticles are inorganic. The nanoparticles are essentially insoluble in water. In one embodiment of the present invention, the nanoparticles are silica or nanosilica. In one embodiment of the invention, the nanoparticles are anionic. In one embodiment of the invention, said silica or nanosilica is anionic at neutral or alkaline pH. In one embodiment of the present invention, the nanoparticles are amphoteric at neutral or alkaline pH. In one embodiment of the present invention, the nanoparticles are non-ionic. The nanoparticles used according to the present invention typically have an average individual diameter in one dimension of from 1 to 100 nm, but can form clusters which are thus larger aggregates of nanoparticles. Preferably, at least 90% of the nanoparticles have a diameter in this range.

The amount of microparticles or nanoparticles added is 0.01 kg to 10 kg, such as 0.1 kg to 9 kg, 0.1 kg to 8 kg, 0.1 kg to 6 kg, 0.1 kg to 5 kg, 0.1 kg to 4 kg, 0.1 kg to 2 kg or 0.1 kg to 1 kg per ton dry furnish.

In one embodiment of the present invention, a specific ratio of polymer to particle is used. The ratio (by weight) depends on the charge and molecular weight of the polymer used, but is typically from about 1:3 to about 1:20, such as from about 1:5 to 1:12 or 1:8 to 1:10.

Said cationic polymer may for example be selected from cationic starch, polyaminoamide-epichlorohydrin (PAE), polyamidoamine (PAMAM), cationic polyacryl amide or copolymer thereof (C-PAM), polyethylene oxide (PEO) or other copolymers thereof or polymers typically used for retention/drainage purposes. Examples of such polymers are cationic polyvinyl amine (PVAm), cationic polydiallyldimethylammonium chloride (PDADMAC), polyethylene imine (PEI), dicyandiamide formaldehyde (DCD), cationic polyvinylalcohol (C-PVA), cationic or amphoteric protein, etc. Further examples of polymers are any copolymer of acrylamide and/or methacrylamide, prepared using at least as one of the comonomers a cationically charged or cationically chargeable monomer. Such monomers include methacryloyloxyethyltrimethyl ammonium chloride, acryloyloxyethyltrimethyl ammonium chloride, 3-(methacrylamido)propyltrimethyl ammonium chloride, 3-(acryloylamido) propyltrimethyl ammonium chloride, diallyldimethyl ammonium chloride, dimethylaminoethyl acrylate, dimethylaminoethyl methacrylate, dimethylaminopropylacrylamide, dimethylaminopropylmethacrylamide, or a similar monomer. The polymer may also contain monomers other than acrylamide, methacrylamide, or some cationic or cationizable monomer.

In one embodiment of the present invention, the polymer is amphoteric. Examples of such polymers are cellulose derivatives such as sodium carboxymethyl cellulose, native or modified starch, proteins, modified polyvinyl alcohol, guar gums, modified hemiceluloses, etc.

In one embodiment of the present invention, the amount of polymer is 0.01 kg to 10 kg per ton dry furnish, such as 0.1 kg to 2 kg or 0.1 kg to 1 kg per ton dry furnish.

In one embodiment of the present invention, salt is added to the pre-mix. Examples or suitable salts are mono, di or trivalent metal salts such as NaCl, $CaCl_2$, $MgCl_2$, $AlCl_3$ etc. The amount of salt added to the pre-mix is between 0.1-50% (wt/wt) based on the solid content of the pre-mix.

In one embodiment of the present invention, the microfibrillated cellulose has a Schopper Riegler value (SR°) of more than 85 SR°, or more than 90 SR°, or more than 92 SR°. The Schopper-Riegler value can be determined through the standard method defined in EN ISO 5267-1.

In one embodiment of the present invention, the MFC is pre-flocculated prior to forming the pre-mix. The pre-flocculation can be achieved by providing a suspension of MFC and mixing or fluidizing MFC and the cationic or amphoteric polymer in said suspension prior to mixing with the microparticle or nanoparticle. The addition of the microparticle or nanoparticles causes the pre-flocculation in said suspension.

The term "pre-flocculation" as used herein is defined as formation of flocks, i.e. aggregates, prior to dosing the pre-mix to the stock in a process for manufacture of a fiber based product.

The term "pre-mix" as used herein is defined as a mixture of the components of the pre-mix prior to dosing the pre-mix to the stock in a process for manufacture of a fiber based product.

In one embodiment of the present invention, the pre-mix is obtained by co-refining or co-fluidizing the components that should form part of the pre-mix. In one embodiment, the co-refining or co-fluidizing can be carried out by a jet cooking approach or by high-shear mixing device such as a homogenizer or rotor stator mixer, optionally combined with the use of refining or beating device.

In one embodiment of the present invention, the pre-flocculated MFC is deflocculated due to shearing when being added to the stock. However, re-flocculation is facilitated by the formation of said pre-mix prior to dosing the pre-mix to the stock in a process for manufacture of paper or board.

In one embodiment of the present invention, the pre-mix is dosed using a TrumpJet system (available from Wetend Technologies Ltd.).

The pre-mix according to the present invention is useful in the manufacture of fiber based products such as paper, board, tissues, nonwovens and films, such as MFC films.

The term furnish as used herein refers to the suspension comprising fibers and chemicals that is deposited on a wire in a process for manufacturing a fiber based product. Such processes for manufacturing a fiber based product are known in the art.

DETAILED DESCRIPTION

Microfibrillated cellulose (MFC) shall in the context of the patent application mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods.

The smallest fibril is called elementary fibril and has a diameter of approximately 2-4 nm (see e.g. Chinga-Carrasco, G., *Cellulose fibres, nanofibrils and microfibrils: The morphological sequence of MFC components from a plant physiology and fibre technology point of view, Nanoscale research letters* 2011, 6:417), while it is common that the aggregated form of the elementary fibrils, also defined as microfibril (Fengel, D., *Ultrastructural behavior of cell wall polysaccharides*, Tappi J., March 1970, Vol 53, No. 3.), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregrates and cellulose microfibril aggregates. MFC can also be characterized by various physical or physical-chemical properties such as large surface area or its ability to form a gel-like material at low solids (1-5 wt %) when dispersed in water. The cellulose fiber is preferably fibrillated to such an extent that the final specific surface area of the formed MFC is from about 1 to about 300 $m^2/g$, such as from 1 to 200 $m^2/g$ or more preferably 50-200 $m^2/g$ when determined for a freeze-dried material with the BET method.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CM), aldehyde and/or carboxyl groups (cellulose obtained by N-oxyl mediated oxydation, for example "TEMPO"), or quaternary ammonium (cationic cellulose). After being modified or oxidized in one of the above-described methods, it is easier to disintegrate the fibers into MFC or nanofibrillar size fibrils.

The nanofibrillar cellulose may contain some hemicelluloses; the amount is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated. MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The above described definition of MFC includes, but is not limited to, the new proposed TAPPI standard W13021 on cellulose nanofibril (CMF) defining a cellulose nanofiber material containing multiple elementary fibrils with both crystalline and amorphous regions.

The papermaking machine that may be used in the process according to the present invention may be any conventional type of machine known to the skilled person used for the production of paper, paperboard, tissue or similar products.

In view of the above detailed description of the present invention, other modifications and variations will become apparent to those skilled in the art. However, it should be apparent that such other modifications and variations may be effected without departing from the spirit and scope of the invention.

The invention claimed is:

1. A process for the production of a fiber based product comprising the steps of:

preparing a pre-mix comprising:

a) microfibrillated cellulose, wherein the amount of the microfibrillated cellulose is 0.1 kg to 50 kg per ton dry furnish;

b) cationic or amphoteric polymer, wherein the amount of the cationic or amphoteric polymer is 0.01 kg to 10 kg per ton dry furnish;

c) microparticles or nanoparticles, wherein the amount of microparticles or nanoparticles is 0.01 kg to 10 kg per ton dry furnish, wherein said microparticles or nanoparticles are silica, microsilica, bentonite or microbentonite particles; and, d) salt in an amount between 0.1 to 50% (wt/wt) based on a solids content of the pre-mix, wherein the salt is selected from a group consisting of sodium chloride, calcium chloride, magnesium chloride, and aluminum chloride; and, dosing said pre-mix to a stock for manufacturing a fiber based product with a furnish comprising the stock.

2. The process according to claim 1, wherein said microparticles or nanoparticles are anionic at neutral or alkaline pH.

3. The process according to claim 1, wherein the weight ratio of polymer to microparticles or nanoparticles is in the range of from 1:3 to 1:20.

4. The process according to claim 1, wherein said cationic or amphoteric polymer is a cationic polymer.

5. The process according to claim 4, wherein said cationic polymer is selected from starch, polyaminoamide-epichlorohydrin and cationic polyacryl amide or copolymer thereof.

6. The process for the production of a fiber based product as claimed in claim 1, wherein the pre-mix is prepared by co-refining or co-fluidizing the components of the pre-mix when manufacturing the microfibrillated cellulose.

7. The process according to claim 1, wherein the weight ratio of polymer to microparticles or nanoparticles is in the range of from 1:5 to 1:12.

* * * * *